US006622788B2

(12) United States Patent
Kaiser et al.

(10) Patent No.: US 6,622,788 B2
(45) Date of Patent: Sep. 23, 2003

(54) EXTERNAL CASING ANCHOR

(76) Inventors: Trent Michael Victor Kaiser, 10912-16 Avenue N.W., Edmonton, Alberta (CA), T6J 5G6; Maurice William Slack, 1831-104A Street N.W., Edmonton, Alberta (CA), T6J 5C1

( * ) Notice: Subject to any disclaimer, the term of this patent is extended or adjusted under 35 U.S.C. 154(b) by 0 days.

(21) Appl. No.: 09/736,977

(22) Filed: Dec. 14, 2000

(65) Prior Publication Data

US 2001/0006109 A1 Jul. 5, 2001

(30) Foreign Application Priority Data

Dec. 14, 1999 (CA) ..... 2292170

(51) Int. Cl.[7] ..... E21B 17/02
(52) U.S. Cl. ..... 166/241.6; 166/195
(58) Field of Search ..... 166/382, 120, 166/121, 180, 195, 241.6, 241.7, 285

(56) References Cited

U.S. PATENT DOCUMENTS

| | | | | | |
|---|---|---|---|---|---|
| 4,619,326 | A | * | 10/1986 | Van Mierlo | 166/382 |
| 4,658,896 | A | * | 4/1987 | Milam | 166/241.6 |
| 5,105,879 | A | * | 4/1992 | Ross | 166/195 |
| 5,579,854 | A | * | 12/1996 | Barry | 175/57 |
| 5,908,072 | A | * | 6/1999 | Hawkins | 166/241.6 |

* cited by examiner

*Primary Examiner*—David Bagnell
*Assistant Examiner*—Zakiya Walker
(74) *Attorney, Agent, or Firm*—Marsh Fischmann & Breyfogle LLP

(57) ABSTRACT

A plurality of steel rings are crimped or shrink fitted onto a joint of steel well casing to produce the casing anchor. The rings and joint are sufficiently interlocked so that, when the anchor is cemented in a well, the joint can transfer axial load from the casing string to the cement through the rings to provide resistance to axial displacement of the anchor relative to the surrounding earth material.

4 Claims, 2 Drawing Sheets

FIG. 5
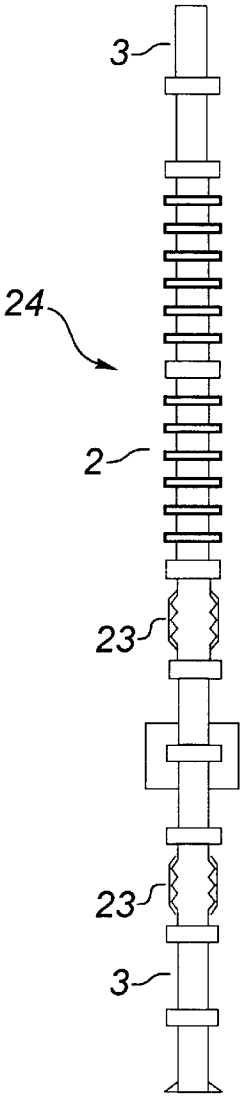
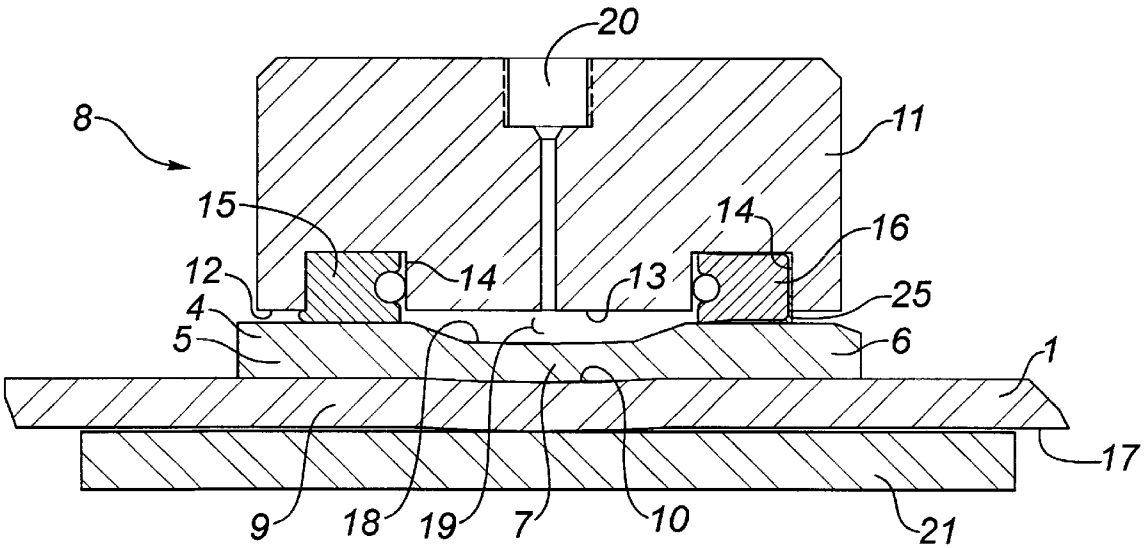
FIG. 4

EXTERNAL CASING ANCHOR

CROSS REFERENCE TO RELATED APPLICATIONS

This application claims priority under 35 U.S.C. §119 from Canadian Patent Application No. 2,292,170 filed on Dec. 14, 1999.

FIELD OF THE INVENTION

The present invention relates to a metal anchor joint for anchoring casing in a well and to tee process of making and using it. More particularly the anchor joint is a thick-walled steel tubular, such as a length of well casing, having outwardly protruding rings affixed thereto.

BACKGROUND OF THE INVENTION

Well structures installed in the earth to exploit geothermal or petroleum energy resources are typically lines with tubular steel casings, which in turn, are cemented in place within the well bore. Under certain conditions, such as significant temperature changes, the casing tends to displace axially relative to the adjacent earth material. The present invention provides a means to restrain such relative displacement.

Within the context of petroleum drilling and completion systems, the vast majority of casing systems need only accommodate the loads arising from installation prior to cementing, and non-thermal production methods after cementing. For these conventional production methods, casing designs typically only consider pressure containment, collapse resistance and hydraulic isolation requirements, and not axial load changes after cementing.

However, in thermal applications, or where ground movements induced by processes such as reservoir compaction may occur, it is often desirable to provide highly efficient axial load transfer over relatively short interval lengths to prevent casing movement and consequent damaging effects on adjoining or attached components of the completion system.

The present invention was conceived specifically as a means to restrain the axial movement of casing strings in well bores which will be used for production of heavy oil by means of the process of steam stimulation. When casing is heated, axial displacement resulting from thermal expansion tends to occur and be concentrated at locations coincident with changes in the axial strength of the tubulars.

These axial displacements are most obvious at ground surface, where the casing ends. Movement at this location typically cases the well head to rise and fall relative to ground surface, correlative with increases and decreases in temperature, respectively. Surface piping connected to the well head must therefore include provisions to accommodate this movement or risk failure. Such provisions and risk increase cost; therefore a cost effective and reliable means to reduce surface well head displacement by restraining or anchoring the casing is advantageous.

Less obviously, changes in axial strength may occur down hole at locations where there is a transition in size, grade or configuration of components in the casing string. For example, such changes occur at liner junctions, or where axially compliant devices such as corrugated tubulars are employed. At these locations, axial movement of the casing occurs relative to the adjacent formation; this tends to concentrate strain in the weakest member of the string, potentially causing it to fail with consequent loss of either structural or pressure integrity.

Because of the generally long string lengths employed to case wells, the magnitude of axial load transferred between the casing and surrounding earth materials through the cement sheath is usually very low, and for typical non-thermal applications, is largely static. Therefore, there has apparently been little interest in developing methods to improve the efficiency of axial load transfer between the casing and cement sheath, beyond what occurs 'naturally' by friction and interlocking at the upset surfaces at connection points.

Even where axial load transfer is considered, the conventional understanding of interaction between the pipe and cement as described by D. K. Smith in "Cementing," SPE Monograph Vol. 4, Society of Petroleum Engineers Inc. January, 1990, anticipates that a cement bond exists, capable of transmitting shear between the casing and cement and hence transferring axial load. This reference reports measured 'bond' strengths ranging from 20 to over 200 psi. These values were derived from cemented tube-in-tube tests where the annular space between two lengths of pipe was cemented. Axial compressive load was then applied to one tube and reacted by the other. For these tests, the effective (radial) stress present across the cement to steel tubular interface is not reported or considered, and the total reported average 'bond' strength is considered adhesive. Hence, designs that do consider axial load transfer typically rely on the presence of this apparent bond mechanism that, if present, would provide substantial load transfer over a relatively short axial length. For example, given a bond strength of 100 psi (which is about mid range of the values reported) a 7 inch diameter pipe could develop a calculated axial load resistance of 500,000 lb over just 18.95 feet. However, as described by Schwall, G. H., Slack, M. W. and Kaiser, T. M. V. in "Reservoir Compaction Well Design for the Ekofisk Field". SPE Paper 36821, 1996 SPE Annual Technical Conference and Exhibition, Denver, Oct. 6–9, 1996, the concept of significant adhesive cement bond was alleged to be erroneous. The interaction behavior between the cement and steel was explained as a frictional mechanism.

While significant frictional forces may be developed along the casing length at depth, this may not always be relied upon, particularly at shallow depths.

With this background in mind, it is the objective of the present invention to provide anchoring means, for incorporation in a casing string, which is intended to function to reduce relative movement between the string and the adjacent earth material.

SUMMARY OF THE INVENTION

In accordance with the invention, an anchor joint for incorporation in a casing string is provided. The anchor joint comprises a thick-walled metal tubular having means (e.g. threads) at its ends for connection with the casing string. The tubular has a plurality of outwardly projecting, abrupt diameter changes spaced along its length.

More particularly, one or more metal rings are crimped or shrink fitted onto the tubular. Preferably, in its instressed condition (that is, prior to crimping or shrink fitting), each ring has an inner diameter equal to or less than the original outside diameter of the tubular.

In a more preferred embodiment, at least one steel ring is crimped onto a steel joint of well casing. The ring has a yield strength less than that of the joint. Crimping may be carried out by hydroforming. As a result of crimping both the joint wall and the ring, a detent is formed in the joint side wall and the ring is trapped within the detent.

By locking the joint and rings together by crimping or shrink fitting, the resulting engagement is sufficient to enable the joint to transfer axial load from the casing string through the ring to the surrounding cement sheath of the well, to provide resistance to axial displacement of the anchor joint relative to the earth material.

As stated, the tubular is "thick-walled". In a general sense, this word is intended to convey that the anchor joint tubular wall is sufficiently strong and thick so as to maintain the structural integrity of the casing string. More specifically, it means that the tubular has a diameter to thickness ratio ("D/t") less than 100, preferably less than 50. Most preferably the tubular is a joint of the casing used in the casing string. By being thick-walled and having end connections, the tubular is compatible with the casing string.

By "abrupt" is meant that the diameter changes create shoulders that preferably are substantially perpendicular to the axis of the tubular or alternatively may be sloped with an angle of at least 20", more preferably at least 45°, relative to the axis of the tubular.

Preferably the joint will have a length in the order of 40 feet, so that it conforms with the average length of casing joints.

It will be apparent that the ability to efficiently transfer axial load between the anchor joint and the wellbore wall through the confining material such as cement typically placed in the annulus between the anchor joint and wellbore wall will depend on the tendency of the multiple abrupt diameter changes to displace the confining material as axial movement is attempted. To provide a significant improvement in the anchoring function of a threaded and coupled anchor joint, the total volume swept by the multiple abrupt diameter changes preferably should be of the same order as that already swept by the face of the joint coupling or collar for a given amount of axial movement. This collar face area is typically approximately equal to the joint body cross-sectional so that the swept volume is this area times the axial displacement. Therefore it is preferred that the relevant upper or lower shoulder areas of the diameter changes of the anchor joint shoulds in total create an area equal to the cross-sectional area of the anchor joint body. Otherwise stated, the total axial area presented by the diameter change or shoulder to the confining material in the direction of movement should preferably be at least equal to the cross-sectional area of the anchor joint tubular body.

In addition, the diameter changes preferably should be of sufficient magnitude to result in significant inter-penetration with the confining material. There may be gaps between the confining material and the anchor joint tubular outer surface, such as the micro-annulus reported to occur between cement and a tubular. In addition, the radial stiffness of the confining material may allow it to deflect away from surfaces where the diameter change tends to cause loading during axial displacement of the casing string. For these reasons, it is preferred that the diameter changes be greater than 0.5% of the tubular diameter, more preferably greater than 1% of the diameter.

In a preferred embodiment, the anchor joint comprises a joint of steel well casing having external, solid steel rings affixed, as by crimping, in locking engagement with the tubular wall.

Preferably the rings are cylindrical, have a thickness abut equal to the tube wall thickness and are spaced apart at least 10 ring thicknesses.

The number of rings and the length of the anchor joint should be selected with a view to providing adequate shoulder contact with the cement or other confining material to react the axial load tending to cause movement of the casing. Selecting the number of rings, the length of anchor joint and the frequency of anchor joints will in part be determined by field experience.

In another preferred embodiment, the invention is concerned with a method for anchoring a casing string in a wellbore comprising: inserting a plurality of anchor joints at spaced intervals into a casing string as the string is being run into the wellbore; each anchor joint comprising a joint of casing having a plurality of external steel rings affixed by crimping or shrink fitting in locking engagement with the joint at spaced positions along the joint, and cementing the anchor joints in the wellbore.

Each crimp ring is preferably secured to the tubular by a hydroforming process comprising:

(a) providing a thick-walled metal tubular compatible with a casing string;

(b) positioning a crimp ring around the tubular, the ring being formed from a ductile material, such as steel, having a yield strength less than the tubular, the ring having an internal diameter slightly greater than the external diameter of the tubular and an external profile comprising end sections and a middle section of reduced outside diameter relative to the end sections;

(c) providing a pressure forming vessel around the ring, the vessel having an internal bore slightly larger than the outside diameter of the ring;

(d) the forming vessel having internal grooves, carrying seals, spaced to straddle the reduced diameter ring middle section and to seal against the end sections to define a pressure chamber between the seals;

(e) providing a stop tube having a length at least equal to that of the ring, within the tubular in opposed relation to the ring, the stop tube preferably having an outside diameter less than the inside diameter of the tubular by an amount at least equal to twice the elastic limit displacement of the tubular;

(f) the vessel having a passage extending through its wall to communicate with the pressure chamber;

(g) introducing pressurized liquid into the pressure chamber through the passage and causing the ring and tubular side wall to deform inwardly until the side wall contacts the stop tube and the ring is affixed to the tubular; and (h) repeating the foregoing steps to affix a plurality of rings to the tubular to produce an anchor joint.

As a further step, the anchor joint so produced is connected into a casing string and introduced into a wellbore and cemented in place.

DESCRIPTION OF THE DRAWINGS

FIG. 4 is a cross-section through the wall of the assembly of FIGS. 2 and 3, showing the configuration of an elastomer metal back up ring for containing the seals; and FIG. 5 is a side view showing a plurality of anchor joints incorporated into a casing string.

DESCRIPTION OF THE PREFERRED EMBODIMENT

Figure 1:
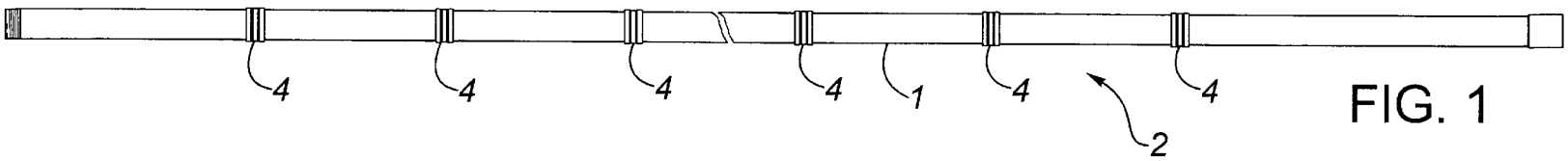
FIG. 1 is a side view of a using anchor joint comprising a tubular having a plurality of crimped rings affixed thereto.

In accordance with one embodiment of the invention a 40 foot joint 1 of steel well casing was provided as the tubular to form the anchor joint 2. The casing joint 1 met the following specification:

grade of steel—API L80 nominal inside diameter—6,366 inch nominal outside diameter—7 inch wall thickness—0.317 steel yield—80,000 psi

The casing joint 1 was threaded at each end to provide means for use in connecting it into a casing string 3. A coupling 22 was secured to one end of the joint 1.

A crimp ring 4 was positioned coaxially around the casing joint 1. The ring 4 met the following specification:

grade of steel—API K55 nominal inside diameter—7 inch length—4 inches steel yield—55,000 psi

The ring 4 had an indented outer surface 15 or profile, creating ring end sections 5, 6 and reduced diameter middle section 7. The wall thickness of each end section 5, 6 was 0.350 inches. The wall thickness of the middle section 7 was 0.245 inches.

A hydroforming assembly 8 was provided to simultaneously yield both the middle section 7 of the ring 4 and the casing joint side wall 9, to leave the ring locked or swaged in a detent 10 formed in the side wall.

More particularly, the assembly 8 comprised a pressure forming vessel 11 having an internal bore 12 extending therethrough, for receiving the casing joint 1 and ring 4. The diameter of the bore 12 was 0.010 inches larger than the outside diameter of the ring 4. The interior surface 13 of the vessel 11 formed seal grooves 14 for receiving elastomeric cup seals 15, 16 which were positioned to seal against the end sections 5, 6, respectively. Suitable seals 15, 16 are available from Parker Seal Group within their POLYPAK® product category. To mitigate the tendency of even these high strength elastomeric seals to extrude, it was found the elastomer could be reinforced with a thin metal ring element 25 placed over the seal corner tending to be extruded where the thin metal ring element 25 has overlapping ends and an L-shaped cross-section. The bottom surface 13 of the vessel 11 combined with the top surface 18 of the ring middle section 7 to form a pressure chamber 19 sealed by the seals 15, 16. A port 20 extended through the body of the vessel 11 to communicate with the pressure chamber 19. Liquid under pressure could be introduced into the pressure chamber 19 through port 20 to deform the ring 4 and casing joint side wall 9.

A stop tube 21, having an outside diameter of 0.060 inches less than the inside diameter of the casing joint and a length approximately 1.5 times that of the ring 4, was inserted into the core 17 of the casing joint 1. The stop tube 21 was positioned opposite the ring 4. The function of the stop tube 12 was to limit the extent of deformation of the ring 4 and casing joint side wall 9 to about 2.5 to 3.5 times the elastic limit of the casing joint steel under external pressure loading.

Figure 3:
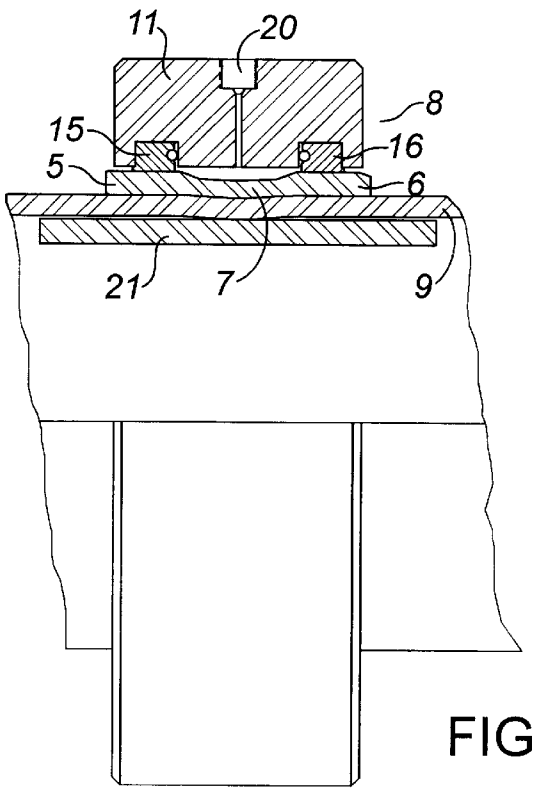
FIG. 3 is a partial cut-away side view of a crimped ring positioned inside the forming vessel under application of the forming pressure.
Figure 2:
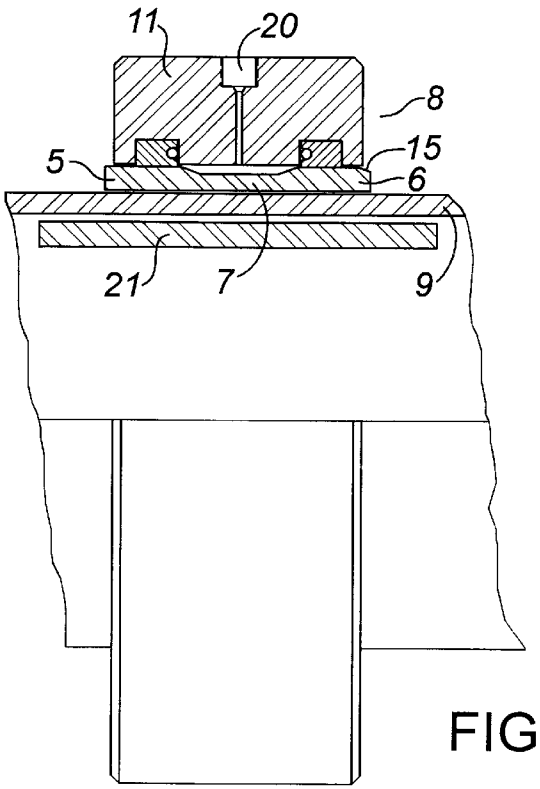
FIG. 2 is a partial cut-away side view of a crimp ring positioned inside the forming vessel and placed on the tubular prior to crimping.

Water under pressure was introduced into the pressure chamber 19. As the pressure was increased, the ring middle section 7 was initially forced into contact with the casing side wall 9. As the pressure was increased to about 15,000 psi, both the ring and casing side wall were forced into contact with the stop tube 21. At this point, the pressure was released. Both the ring 4 and side wall 9 rebounded As the yield strength of the ring 4 was less than that of the side wall 9, the ring rebounded less, thereby leaving some residual contact stress between the casing side wall 9 and ring 4. The ring 4 was left plastically formed into the slight detent 10 in the side wall 9, and was thus plastically interlocked into the casing wall, as shown in FIG. 3.

This process was repeated to affix 10 rings 4 onto the 40 foot casing joint 1 at a spacing of approximately 3 feet, thereby completing production of the anchor joint 2 shown in FIG. 1.

Two such anchor joints 2 were then inserted in a casing string 3, as shown in FIG. 5, together with corrugated compression joints 23 (available from SynTec Inc. of Edmonton Alberta, Canada, under the trade mark DuraWAV). The assembly 24 was then run into a well and cemented in place.

When an anchor joint thus formed is cemented into a well, the cement cast around the rings provides a compressive reaction point at each ring face, effectively 'locking' them into the cement. If the casing is subsequently subjected to sufficient axial load to cause it to displace relative to the rings and cement, such movement requires the rings to move out of the detent. But this creates additional interference with associated increase in contact stress and frictional resistance tending to arrest the movement and providing the desired anchor function. The limited amount of slip thus allowed by the crimped rings, provides a 'softer' anchor than rigidly attached rings, delivering more uniform distribution of load transfer between multiple rings with less tendency to sequentially fail the cement. Crimped rings are thus the preferred method of providing a multiplicity of diameter changes on a tubular article functioning as a casing anchor joint. The preferred embodiment of using a hydraulic swaging process to install the crimp rings also avoids potential embrittlement or corrosion attack that may otherwise arise if the rings were welded onto the casing.

Sample Application

Removal of fluids and solids from hydrocarbon bearing reservoirs such as unconsolidated channel sands on primary production, can lead to either global or local compression of the reservoir. In either case, compression tends to be greatest near the producing well bore allowing "roof caving" and "floor bulging" to reduce the original thickness Near vertical production casings traversing such a reservoir interval will thus tend to be shortened or compressed. Reservoir vertical compressive strains range from fractions to tens of a percent. Given the limited elastic range of casing steel, typically 0.25%, straight casing is usually loaded near or beyond its elastic limit [yield capacity].

This in itself leads to potentially damaging compressive loads at connections or perforations, but when combined with reduced lateral support, causes the casing to buckle. Lateral support in such unconsolidated sandstone reservoirs is lost through production of solids. The curvature and magnitude of the resultant buckled shape allowed by the available annular space increases stress, reduces collapse capacity, impairs access and may damage production equipment, such as pumps, located inside the casing in the buckled interval.

If short sections or pups of compliant casing, as described in U.S. patent application Ser. No. 60/132,632, are placed in the casing string above and below the compressing reservoir interval, axial load is reduced, and consequently the buckling amplitude and curvature can be reduced or eliminated, where the interval thickness does not exceed a few tens of meters. However, if these wells are subsequently thermally stimulated by steaming, the heated casing outside this interval will tend to expand and potentially displace into the compliant casing pumps known by the trade mark DuraWAV. Furthermore, most thermal stimulation processes impose some temperature cycles, even if not intentionally, further tending to over strain the DuraWAV tools.

These deleterious consequences can be overcome if casing anchor joints are employed, particularly above the upper DuraWAV tool as shown in FIG. 5. This figure schematically shows a well design using 7 inch (178 mm) casing joined with industry standard buttress threaded couplings (BT&C) or 8-round short thread couplings (ST&C). Reservoir thicknesses range from less than 10 meters up to about 30 meters thickness. Two anchor joints are employed above the upper DuraWAV tool to ensure heated casing is prevented from displacing downward and compromising the ability of the DuraWAV tool to absorb reservoir compressive strain or maintain pressure integrity.

Alternate Embodiments

In another aspect of the preferred embodiment, the rings can be crimped on the casing to form an anchor joint by application of radial force provided by mechanical rather than hydrostatic means. Such mechanical means include split dies forced together by a press or collet jaws forced together by an axially loaded cone.

In another aspect of the preferred embodiment, we believe the rings providing a multiplicity of diameter changes could be fastened to the casing by welding.

In another aspect of the preferred embodiment shrink-fitting rings onto the casing can be employed as a means to provide a multiplicity of diameter changes.

As an alternative embodiment, we believe machining grooves in a sufficiently heavy wall tubular may provide the multiplicity of diameter changes. Such grooves may be used alone or fitted with split rings retained in the grooves with fasteners or welding on the split planes.

In another aspect of the present invention the function of the anchor joint may be provided by joining a series of short threaded and coupled pups. Similarly external upset integral joint pups may also be employed to provide a multiplicity of diameter changes over an axial length relatively short in comparison to a full length of casing.

The embodiments of the invention in which an exclusive property or privilege is claimed are defined as follows:

1. An anchor joint for inclusion in a casing string which is to be cemented with cement in a well extending through earth material, comprising:

a thick-walled tubular having a side wall, an external surface and means at its ends for connection with the casing string, whereby the tubular is compatible with the casing string;

a plurality of metal rings crimped or shrink fitted onto the tubular's external surface at spaced intervals along its length so that each ring of the plurality of rings and the tubular are locked together and the plurality of rings can transfer axial load from the casing string and tubular to the cement to provide resistance to axial displacement of the anchor joint relative to the earth material.

2. The anchor joint as set forth in claim 1 wherein:

the tubular has an outside diameter; and the outside diameter of said each ring is at least 1% greater than the tubular diameter.

3. The anchor joint as set forth in claim 1 wherein:

said each ring has a yield strength less than that of the tubular, said each ring has been crimped onto the tubular, and said each ring and the tubular have been plastically deformed simultaneously during crimping, so that said each ring is locked in a detent formed in the side wall of the tubular.

4. The anchor joint as set forth in claim 1 wherein:

said each ring has been crimped onto the tubular;

said each ring is characterized by having an inner diameter after crimping equal to or less than the original outside diameter of the tubular and a yield strength less than that of the tubular; and said each ring and the tubular have been plastically deformed simultaneously during crimping, so that said each ring is locked in a detent formed in the side wall of the tubular.

* * * * *